United States Patent [19]

Holding

[11] 4,356,587

[45] Nov. 2, 1982

[54] BRUSH COMPONENTS AND THEIR MANUFACTURE

[75] Inventor: David Holding, Bolton, England

[73] Assignee: Schlegel (UK) Limited, Seacroft, England

[21] Appl. No.: 175,660

[22] Filed: Aug. 6, 1980

[30] Foreign Application Priority Data

Aug. 7, 1979 [GB] United Kingdom ..... 7927461

[51] Int. Cl.[3] ..... A46B 1/00; A46B 3/16; B29D 31/00

[52] U.S. Cl. ..... 15/199; 15/DIG. 3; 300/21; 264/243; 264/174

[58] Field of Search ..... 15/199, 179, 180, 181, 15/182, 183, DIG. 3; 300/21; 264/243, 174; 425/805

[56] References Cited

U.S. PATENT DOCUMENTS

| | | | |
|---|---|---|---|
| 2,303,386 | 12/1942 | Peterson | 300/21 X |
| 2,812,214 | 11/1957 | Sandelin | 300/21 |
| 2,995,401 | 8/1961 | Peterson | 15/DIG. 3 |
| 3,139,975 | 7/1964 | Schaefer | 15/DIG. 3 |

FOREIGN PATENT DOCUMENTS

| | | | |
|---|---|---|---|
| 24783 | 8/1951 | Finland | 300/21 |
| 2356541 | 1/1978 | France | 15/250.04 |
| 7536 | of 1914 | United Kingdom | 300/21 |

*Primary Examiner*—Peter Feldman
*Attorney, Agent, or Firm*—Cumpston & Shaw

[57] ABSTRACT

A method of manufacturing brush components is disclosed wherein an array of bristles which may either be loosely arranged in which case they should be substantially aligned or may be in the form of a knitted or woven tape is overlain by a membrane e.g. a polythene or polypropylene sheet, the bristles and membrane then being bent through 180° about the center line of the array into a generally U-shaped configuration and subsequently held in that position by clamping means e.g. a metal channel or an extruded plastics beading. Preferably a strengthening wire is located over the top of the membrane and within the U at the base thereof.

15 Claims, 4 Drawing Figures

BRUSH COMPONENTS AND THEIR MANUFACTURE

This invention relates to an improved method of manufacturing brushes and to brushes and the brush components made by the improved method.

In our U.K. Patent No. 1457074 a method of manufacturing brush components is disclosed wherein a knitted type of yarn folded upon itself into a zig-zag is converted into brush components by having a locking element secured to an edge thereof either before or after a slitting operation. In our co-pending British Application No. 7901230, further methods of brush manufacture are disclosed wherein bristle elements are advanced through endless draw-off belts, locking beads are extruded on the bristle elements and a folding or slitting operation is performed.

It is also possible to manufacture brush components by making a tow of endless bristle elements and weaving this with a suitable warp yarn to provide a woven fabric, which subsequently has plastics beads extruded onto it transverse to the tow wefts and is slit into brush component tapes. In our co-pending patent application No. 7918652, brushes formed from two or more brush tapes formed by the methods disclosed in our previously mentioned patent applications are disclosed. Double tape brushes formed in accordance with the teachings of this patent application No. 7918652 may incorporate a membrane between the tapes to act as a barrier there.

In U.K. Patent Specification No. 730131, a method of manufacturing brush strips is disclosed wherein an organic material is heated to plastic state and is extruded through a mouthpiece into a continuous U-shaped strip through a groove-shaped guide member, whereupon a plurality of aligned bristles are conveyed by means of an endless belt together with a thread of metal and are folded around a guide cam and led into the open topped guide member. The guide member has a tapering slot in its upper surface at the bristle feed-in location, and as the bristles are advanced and the U-shaped strip is pulled out of the guide member, so the bristles are folded with their ends upwards by the narrowing slot and pressed down into the U-shaped strip. In this way, the side walls of the U-shaped strip are pressed against the bristles which are partly pressed into the soft material of the strip and held therein. It is preferred that the strip is cooled on emergence from the extruder so that it maintains its shape better.

Brush strips made in accordance with the above teachings are wholly unsatisfactory in that, due to the low temperature of the U-shaped strip, the bristles are only pressed into its surface and only form a rather unsatisfactory mechanical key with the strip. This means that after a few uses, the bristles may fall out of the strip.

In U.K. Patent Specification No. 881612, a method of manufacturing a composite brushing tool is disclosed wherein bristles and a band of uncured plastics material such as Neoprene incorporating a blowing agent are bent in the form of a U around a wire, the whole assembly then being clamped in position by means of a steel strip. This strip may then be wound upon a mandrel, which is then placed in an oven to blow and cure the elastomeric material, which flows between the bristles to provide a surrounding matrix. The resultant brushing tool preferably incorporates hard bristles, e.g. of wire, and when used as a rotary brush, the matrix or elastomeric body wears away faster than the bristles, thus always leaving a part of the bristles exposed. Clearly, brushing tools formed in this manner are quite different from brush components incorporating a barrier layer, and if the bristles were formed of a thermoplastics or thermosetting material, they would melt when the tool was placed in the oven to cure the elastomeric body.

We have now developed a further method of manufacturing brush components incorporating a membrane within the bristles.

According to the present invention, we provide a method of manufacturing a brush component wherein a plurality of bristles are arranged substantially in line in the required density, wherein the line of bristles and a membrane are superimposed, one above the other so that the membrane extends from one end of the bristles across at least half the length of the bristles, whereupon the bristles and the membrane are folded through 180° about the substantial midpoint of the bristles into a generally U-shaped configuration, and are held in this position by clamping means in the vicinity of the 180° fold.

Preferably, the membrane is located internally of the folded over bristles and the clamping means are applied over the bristles in the vicinity of the fold.

Preferably, a strengthening device is incorporated in the thus formed brush component in the vicinity of the fold. Preferably, the strengthening device is in the form of a metal wire located within the base of the U and about which the bristles and membrane are folded. The wire may be plastics coated.

The clamping means may be in the form of a metallic channel which is pressed around the outer periphery of the base of the U or alternatively it may be in the form of one or more plastics beadings extruded around the bristles either before, during or after the bristles and membrane have been bent through 180°. If one or more strips of plastics beading are used as the clamping means, then the bristles and membrane are preferably formed of compatible plastics materials which will fuse with the extruded beading.

Although it is envisaged that the bristles may be loosely arranged prior to formation of the brush component, it will be appreciated that they could be provided in the form of a knitted or woven tape such as those disclosed in our previously mentioned patent specifications, the warp yarns except those in the vicinity of the clamping means being removed from the bristles subsequent to the forming operation.

Also according to the present invention, we provide a brush component comprising an array of aligned bristles bent into a generally U-shaped configuration with a membrane located on a face of or within the bristles and extending throughout the depth of at least one arm of the U and around the base and clamping means to maintain the bristles in their generally U-shaped configuration and the membrane in place.

Preferably, a strengthening device such as a wire, which may be plastics coated, is located within the U at the base thereof and extending throughout the length of the U, and the membrane is located within the U, and bent with the bristles into a U-shaped configuration, preferably around the strengthening device.

The clamping means may be in the form of a metal channel pressed around the outer periphery of the base of the U or alternatively it may be in the form of one or more plastics beadings extruded around the base of the U.

The invention is now described by way of example with reference to the accompanying schematic drawings in which.

Figure 1:
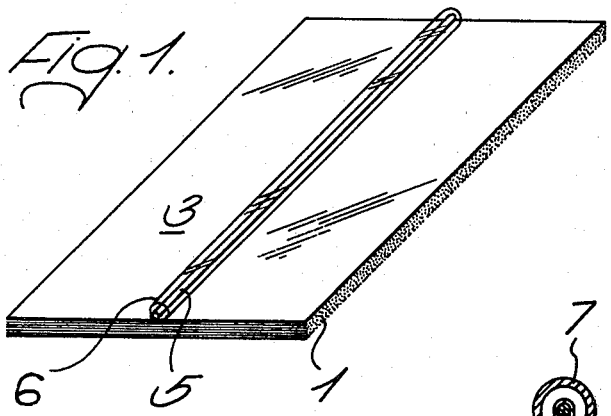
FIG. 1 is a perspective view of a brush component at a preliminary stage of its formation.

Referring to the drawings, FIG. 1 shows an array of parallel aligned bristles 1 overlain by a membrane 3. Preferably the membrane is formed of an impervious sheet material e.g. a polythene or polypropylene sheet. A strengthening device in the form of a wire 5 is then placed over the membrane 3 extending along the mid-point of the bristles 1 and sheet 3 throughout its length. The two side edges of the membrane 3 preferably extend at least to the ends of the bristles 1. The bristles and membrane may be aligned in any suitable manner for example by using a pair of parallel spaced sets of haul-off belts which grip the side edges of the membrane 3 and ends of the bristles 1 or by using a central set of haul-off belts in which case the wire 5 can be gripped as well. After the parts of the brush component have been laid out as shown in FIG. 1, the bristles and membrane 3 are bent about the centre line of the membrane i.e. folded about the wire 5 through 180° to the position shown in FIG. 2 (which is inverted relative to FIG. 1) whereupon the bristles and membrane are maintained in this position by means of a metal channel 7 which is pressed onto the back of the U around the base thereof and clamped in this position.

Figure 3:
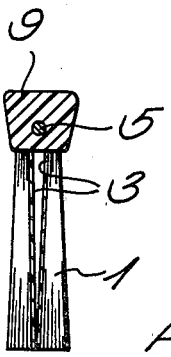

In the alternative construction shown in FIG. 3, the metal clamping channel 7 is replaced by an extruded plastics bead 9 which, as can be seen from FIG. 3, can be made to fuse with the bristles 1 and membrane 3 if the bristles and membrane are formed of a compatible synthetic resinous material to that of the beading 9. Although a single beading 9 is shown which fuses completely with the bristles and membrane, it will be appreciated that two or more individual beadings could be provided which need not completely fuse throughout the whole of the base of the U. It is preferred however, that this occurs to maintain the bristles in their bent over configuration and of course, if the wire 5 has a plastics coating such as coating 6 as shown in FIG. 1, which is also compatible, this can also be fused with the other plastics materials.

Although it is preferred that a strengthening device such as the wire 5 be provided so that the formed brush component can be bent into different configurations, it is not essential and can be omitted. Of course, if a metal channel 7 is used to maintain the bristles and membrane in their bent over configuration, then this metal channel itself will withstand a certain amount of bending.

Figure 4:
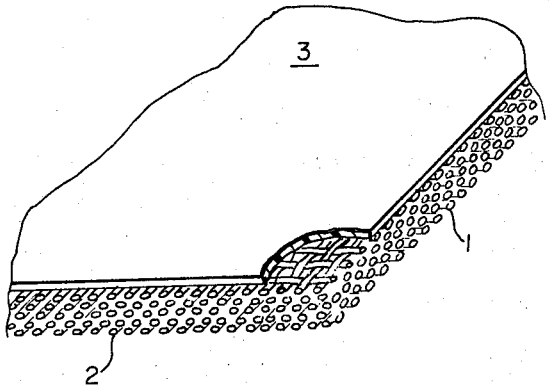
FIG. 4 is a partial cutaway perspective view of the brush component of FIG. 1 showing a woven brush tape.

If desired, the aligned bristles 1, instead of being supplied in loose manner, can be supplied in the form of a knitted brush tape, such as is shown in our U.K. Pat. No. 1,457,074, or in the form of a woven brush tape such as is disclosed in our U.K. patent application No. 7917976 FIG. 4 shows the use of a woven brush tape. A small portion of the construction of FIG. 1 is shown having parallel aligned bristles 1 and warp yarns 2 forming a woven brush tape overlain by membrane 3 as in the construction of FIG. 1. Obviously, in this case, the warp yarns 2 except those in the vicinity of the base of the U, will have to be removed prior to use of the brush.

If desired, the partially formed brush component shown in FIG. 1 can be fed to a special former for example by means of two sets of spaced haul-off belts and the rear face of the bristles 1 can be moved against a plough which cooperates with a folding blade to fold the bristles and membrane into a generally U-shaped configuration. The folding blade would of course be located on the side of the bristles and membrane remote from the plough and if a wire 5 is to be provided the face of the folding blade could be suitably formed to accommodate the wire.

The plough could of course be adapted to apply the metal channel to the back of the folded over bristles and the whole component could then be passed through the nip of a pair of clamping rollers to clamp the channel in position. Alternatively, the plough could lead to an extrusion machine to apply the plastics beading and the brush component could then be hauled-off in suitable manner, out of the extrusion machine.

Figure 2:
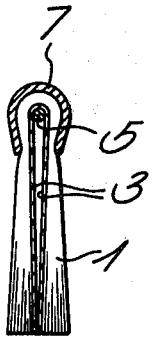
FIG. 2 is an end view showing the brush component after its final formation and, FIG. 3 is a view similar to FIG. 2 but showing an alternative embodiment.

Although it is preferred that the membrane 3 extend throughout the total length of the bristles 1 as shown in FIG. 1, it will be appreciated that this does provide a two layer membrane as shown in FIG. 2. If a single layer membrane only is required, the membrane need only extend from one end of the bristles 1 to just beyond the centre line of the bristles, i.e. just beyond the location of the strengthening member 5 so that when the bristles are bent into their U-shaped configuration, the membrane edge will also be bent into a U-shaped configuration.

In the illustrated construction the membrane 3 is shown bent upon itself in the form of a U and located within the bristles. It will be appreciated, however, that other constructions are possible. For example, the membrane could be located exteriorly of the bristles and bent into a U-shaped configuration with the bristles and could extend down one face only or both faces of the bristles. Alternatively, the membrane could be located within the array of bristles, that is, sandwiched between what is effectively two arrays of bristles, which would then subsequently be bent into a U-shaped configuration and held in that position by the clamping means. Furthermore, the membrane may be pleated, or formed of separate overlapping sheets to give flexibility.

While it is preferred that the plastics bead 9 be provided by extruding extra material onto the bristles, it will be appreciated that the bristles, and the barrier membrane 3, and any plastics coating on the wire 5 will become heated and tend to fuse during their passage through the extruder. It is envisaged therefore that a mere heating step alone may be sufficient to cause this fusion, to hold the brush element together, and in this case, while still soft, the fused portion of the brush element would be passed through a former to form the edge into a bead.

Without a bead of some kind, it is not so easy to locate and secure the brush element into a holder.

I claim:

1. A method of manufacturing a brush component comprising the steps of arranging a plurality of bristles of synthetic resinous material substantially in line in the required density; arranging a membrane of synthetic resinous material which is compatible with that of the bristles relative to the line of bristles such that the line of bristles and membrane are superimposed one above the other so that the membrane extends from one end of the bristles across at least half the length of the bristles; folding the bristles and the membrane through 180° about the substantial midpoint of the bristles into a generally U-shaped configuration; holding the bristles and membrane in this folded position and passing the folded bristles and membrane through an extruder and at the same time causing the folded portion to be heated and thus softened and extruding a beading of synthetic resinous material compatible with that of the bristles and membrane onto said folded portion at a temperature and pressure sufficient to cause fusion between the membrane, bristles and beading.

2. A method according to claim 1 wherein the bristles and membrane are folded such that the membrane is located internally of the bristles.

3. A method according to claim 1 wherein a strengthening device is incorporated in the thus formed brush component in the vicinity of the fold.

4. A method according to claim 3 wherein the strengthening device is in the form of a metal wire located within the base of the U and about which the bristles and membrane are folded.

5. A method according to claim 4 wherein the wire is coated with a synthetic resinous material which is compatible with the other synthetic resinous materials.

6. A method according to claim 1 wherein the bristles are in the form of a knitted or woven tape, the warp yarns except those in the vicinity of the clamping means being removed from the bristles subsequent to the forming operation.

7. A brush component comprising an array of aligned synthetic resinous bristles bent into a generally U-shaped configuration with a membrane of synthetic resinous material compatible with that of the bristles associated with the bristles and extending throughout the depth of at least one arm of the U and an extruded clamping beading of synthetic resinous material compatible with that of the bristles and membrane extending around the base of the U, said extruded beading being fused with the bristles and membrane to maintain the bristles in their generally U-shaped configuration and to maintain the membrane in place.

8. A brush component according to claim 7 wherein a strengthening device is located within the U at the base thereof and extending throughout the length of the U.

9. A brush component according to claim 8 wherein the membrane is located within the U, and is bent with the bristles into a generally U-shaped configuration, around the strengthening device.

10. A brush component according to claim 8 wherein the strengthening device is a length of wire.

11. A brush component according to claim 10 wherein the wire is coated with synthetic resinous material compatible with that of said bristles and membrane.

12. A brush component according to claim 8 wherein a strengthening device is located within the U at the base thereof and extending throughout the length of the U and wherein the membrane is located within the U, and is bent with the bristles into a generally U-shaped configuration around the strengthening device.

13. The method of manufacturing a brush component comprising the steps of arranging a plurality of synthetic resinous bristles substantially in line in the required density, arranging a synthetic resinous membrane of a width equal to at least half the length of the bristles over the line of bristles, and superimposing a wire coated with synthetic resinous material over the membrane substantially along the centre of the line of bristles, and wherein all said synthetic resinous materials are compatible, folding the bristles and membrane through approximately 180° around said wire in a configuration of generally U-shaped cross section, passing the folded configuration through an extruder so as to soften the folded portion thereof, and extruding a beading of synthetic resinous material compatible with said other synthetic resinous material over the softened folded portion at a temperature and pressure sufficient to cause fusion of all four synthetic resinous materials.

14. A method of manufacturing a brush component comprising the steps of arranging a plurality of synthetic resinous bristles substantially in line in the required density, arranging a synthetic resinous membrane of a width equal to at least half the length of the bristles over the line of bristles, and superimposing a wire coated with synthetic resinous material over the membrane substantially along the centre of the line of bristles, and wherein all said synthetic resinous materials are compatible, folding the bristles and membrane through approximately 180° around said wire in a configuration of generally U-shaped cross section, passing the folded configuration through a heater so as to melt the synthetic resinous materials of the wire coating, membrane and bristles in the vicinity of the fold, and then passing the melted parts through a former to form a bead and cause the coating, membrane and bristles in the vicinity of the fold to be fused together.

15. A brush component comprising an array of aligned synthetic resinous bristles bent into a generally U-shaped configuration with a membrane of synthetic resinous material compatible with that of the bristles associated with the bristles and extending throughout the depth of at least one arm of the U and a beading to maintain the bristles and membrane in their generally U-shaped configuration, said beading being formed from the synthetic material of the membrane and bristles by passing the folded portion thereof first through a heater at a temperature sufficient to melt said synthetic materials and then through a former to cause fusion of said materials and formation of said beading.

* * * * *